US011383943B2

(12) United States Patent
Hara

(10) Patent No.: US 11,383,943 B2
(45) Date of Patent: Jul. 12, 2022

(54) FEEDING APPARATUS

(71) Applicant: CANON KABUSHIKI KAISHA, Tokyo (JP)

(72) Inventor: Tomoya Hara, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 12 days.

(21) Appl. No.: 16/936,259

(22) Filed: Jul. 22, 2020

(65) Prior Publication Data

US 2021/0032053 A1 Feb. 4, 2021

(30) Foreign Application Priority Data

Jul. 31, 2019 (JP) ..... JP2019-141566

(51) Int. Cl.
*B65H 1/04* (2006.01)
*B65H 1/26* (2006.01)
*B65H 7/02* (2006.01)

(52) U.S. Cl.
CPC ..... *B65H 1/04* (2013.01); *B65H 1/266* (2013.01); *B65H 7/02* (2013.01); *B65H 2405/114* (2013.01); *B65H 2511/12* (2013.01)

(58) Field of Classification Search
CPC . B65H 1/04; B65H 1/266; B65H 7/00; B65H 7/02; B65H 2405/114; B65H 2405/1144; B65H 2511/12
See application file for complete search history.

(56) References Cited

U.S. PATENT DOCUMENTS

2002/0080426 A1* 6/2002 Ito ..... B65H 7/02 358/498
2008/0122163 A1* 5/2008 Windsor ..... B65H 1/04 271/154
2010/0052246 A1* 3/2010 Sing ..... B65H 1/266 271/171
2017/0001816 A1 1/2017 Ichikawa
2019/0062079 A1* 2/2019 Kikuta ..... B65H 1/18
2020/0399081 A1* 12/2020 Nishiyama ..... B65H 1/14

FOREIGN PATENT DOCUMENTS

JP H03166129 A 7/1991
JP 2017-013978 A 1/2017

* cited by examiner

*Primary Examiner* — Prasad V Gokhale
(74) *Attorney, Agent, or Firm* — Canon U.S.A., Inc. I.P. Division

(57) ABSTRACT

A feeding apparatus includes a stacking portion, a regulating portion, a moving portion, and a detection unit. The regulating portion abuts, in a width direction, one side of stacking portion sheets having different widths and regulates movement of the sheets in the width direction. The detection unit detects a position of the moving portion in an intersecting direction. The regulating portion includes an abut portion. By abutting or not abutting the abut portion, the moving portion moves to a first position and a second position. When the moving portion moves to the first position or the second position in a predetermined proceeding direction, the moving portion does not move from the first position or the second position while the regulating portion takes a position where the regulating portion further moves in the predetermined proceeding direction.

21 Claims, 7 Drawing Sheets

FIG. 8

| CASSETTE/SIDE GUIDE POSITION | SWITCH SENSOR 162 | SWITCH SENSOR 172 |
|---|---|---|
| A4 WIDTH (210 mm) | OFF | ON |
| B5 WIDTH (176 mm) | ON | ON |
| A5 WIDTH (148 mm) | ON | OFF |
| CASSETTE EXTRACTION STATE | OFF | OFF |

FEEDING APPARATUS

BACKGROUND

Field

The present disclosure relates to a feeding apparatus.

Description of the Related Art

A known technology detects the size of sheets that are housed in a cassette for stacking sheets thereon or that are placed on a tray in a feeding apparatus that feeds the sheets to a recording apparatus or the like.

US-2017-0001816 discloses detecting the position of a regulating member by pressing a push switch installed on an apparatus by using a link mechanism that operates in conjunction with the regulating member for regulating sheets housed in a cassette, thereby detecting the size of stacked sheets.

SUMMARY

In recent years, for a purpose of size reduction and cost reduction of apparatuses, it is desired to reduce the number of components of a size detection mechanism for sheets stacked on a cassette and simplify the mechanism. The apparatus in US-2017-0001816 is, however, complex since the apparatus uses the link mechanism and includes a large number of components in a drive mechanism for pressing the push switch.

The present disclosure provides a technology that performs, with a simple configuration, size detection of sheets stacked on a stacking portion.

According to an aspect of the present disclosure, a feeding apparatus includes a stacking portion configured to be stacked with sheets having different widths, a regulating portion disposed on the stacking portion to be movable in a width direction of the sheets and configured to abut one side of the stacked sheets in the width direction and regulate movement of the sheets in the width direction, a moving portion disposed on the stacking portion and movable to a first position and a second position in an intersecting direction intersecting the width direction in accordance with a position of the regulating portion, a detection unit configured to detect a position of the moving portion in the intersecting direction, and a determination unit configured to determine a size of the sheets stacked on the stacking portion based on a detection result of the detection unit, wherein, by abutting or not abutting an abut portion configured to move along with a movement of the regulating portion in the width direction, the moving portion moves to the first position and the second position, and wherein, when the moving portion has moved to the first position or the second position by movement of the regulating portion in a predetermined proceeding direction, the moving portion does not move from the first position or the second position while the regulating portion takes a position where the regulating portion further moves in the predetermined proceeding direction.

Further features of the present disclosure will become apparent from the following description of exemplary embodiments with reference to the attached drawings.

BRIEF DESCRIPTION OF THE DRAWINGS

FIG. 8 is a table showing a relationship between sheet widths and output signals of the sheet-width detection levers in the present embodiment.

DESCRIPTION OF THE EMBODIMENTS

Figure 1:
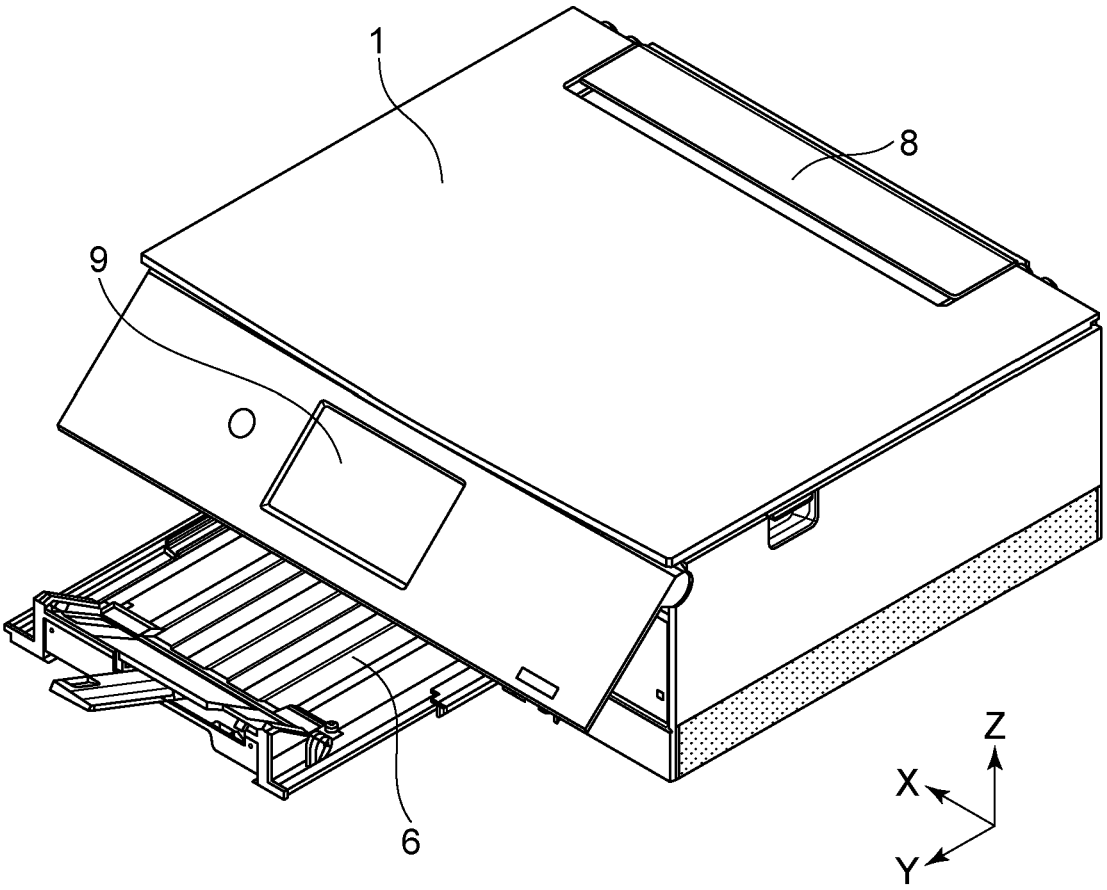
FIG. 1 is a schematic perspective view of an inkjet printer according to the present embodiment.
Figure 2:
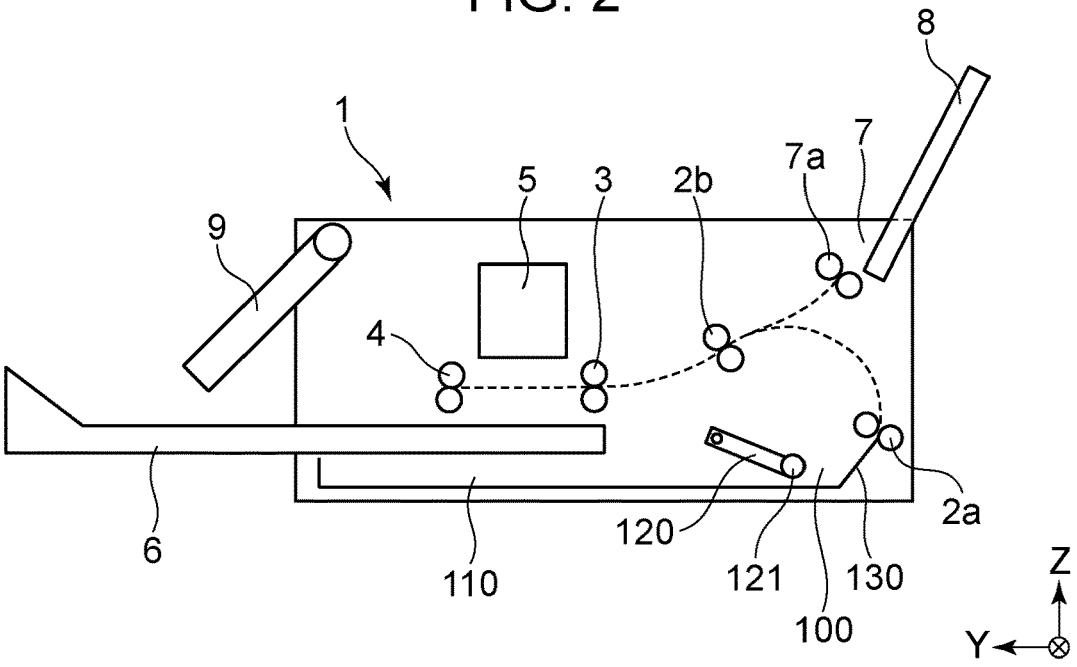
FIG. 2 is a schematic sectional view of the inkjet printer according to the present embodiment.

FIG. 1 is a schematic perspective view of an inkjet printer 1 according to the present embodiment. FIG. 2 is a schematic sectional view of the inkjet printer 1 according to the present embodiment.

The inkjet printer 1 is constituted by, mainly, a cassette feeding mechanism 100, intermediate roller pairs 2*a* and 2*b*, a transport roller pair 3, a discharge roller pair 4, a recording head 5, a discharge tray 6, a rear feeding mechanism 7, and a display portion 9.

The cassette feeding mechanism 100 is constituted by a cassette 110 for stacking sheets thereon, a swing arm 120, which is a sheet feeding unit, and a separating plate 130, which is a separating unit that separates a sheet on an uppermost surface of stacked sheets from other sheets to feed only the sheet. Sheets stacked on the cassette 110 are fed to the intermediate roller pairs 2*a* and 2*b* by a pickup roller 121 mounted on the swing arm 120 and fed to an inner portion of the apparatus. The sheets are media with which at least recording is possible. The sheets are, for example, sheets of paper.

The rear feeding mechanism 7 is constituted by a rear feeding tray 8 for stacking sheets thereon and a pickup roller pair 7*a*, which is a sheet feeding unit. Sheets stacked on the rear feeding tray 8 are transported to the intermediate roller pair 2*b* by the pickup roller pair 7*a*.

The transport roller pair 3 is driven by a motor and a gear train, which are not illustrated, to transport a sheet by a required amount. A sheet is transported to a location, which is an image formation section, facing the recording head 5 by being transported while being nipped by the transport roller pair 3. A tip of the sheet transported from the intermediate roller pairs 2*a* and 2*b* is made to abut the transport roller pair 3 in a stopped state, and skew correction of the sheet is thereby performed. After skew correction is performed, the transport roller pair 3 is driven and transports the sheet in a transport direction (Y direction) to a location facing the recording head 5, and the recording head 5 ejects ink to thereby form an image.

The recording head 5 is configured to be supplied, as appropriate, with ink of each color from ink tanks (not illustrated). The recording head 5 forms an image by ejecting ink droplets onto a recording surface of the sheet while being reciprocated by a carriage (not illustrated) in a sheet-width direction (X direction) intersecting the transport direction. When recording of one line is completed through scanning by the recording head 5, the transport roller pair 3 transports the sheet by a predetermined amount. In other words, while the sheet is intermittently transported by the transport roller pair 3, the recording head 5 performs image formation. The sheet on which recording has been performed is discharged by the discharge roller pair 4 and stacked on the discharge tray 6.

The display portion 9 indicates information relating to the inkjet printer 1. The information to be indicated is, for example, information on the types and sizes of sheets stacked on the cassette 110 or the rear feeding tray 8, information on the state of an operation currently performed by the inkjet printer 1, and information on the content of an occurred error and a solution for the error.

The inkjet printer 1 includes a CPU, a RAM, and a ROM, which are not illustrated. The ROM stores a program of operations to be executed in the inkjet printer 1. The CPU deploys the program stored in the ROM to the RAM and causes the mechanisms to operate according to the program.

Figure 3:
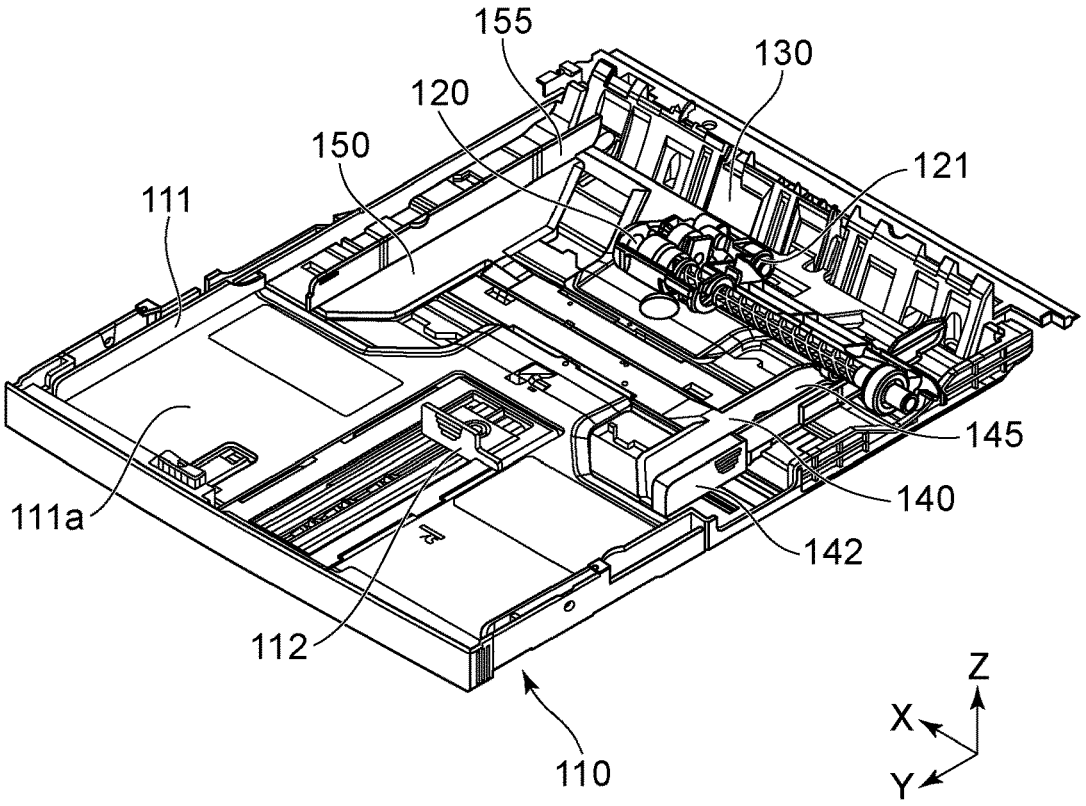
FIG. 3 is a perspective view of a cassette feeding mechanism according to the present embodiment.

Next, the mechanism and the operation of the cassette feeding mechanism 100 in the present embodiment will be described more specifically. FIG. 3 is a top perspective view illustrating the overall configuration of the cassette feeding mechanism 100.

The cassette 110 is a stacking portion for stacking sheets thereon and is mounted on the apparatus body of the inkjet printer 1 so as to be dismountable. The cassette 110 is extracted from the inkjet printer 1 by being moved in +Y direction. The cassette 110 is mounted on a mount portion of the inkjet printer 1 by being moved in a mounting direction, which is −Y direction, and enters a state in which it can perform sheet feeding. The cassette 110 is at least configured to be stacked with sheets so as to be able to feed the sheets. The cassette 110 may not be in the form separable from the apparatus body.

The cassette 110 is constituted by a cassette body 111; a rear-end guide 112; a first side guide 140, a second side guide 150, a gear 113; and sheet-width detection levers 160 and 170. The sheet-width detection levers 160 and 170 each function as a moving portion movable in the Y direction; which is a direction in which the cassette 110 is mounted and dismounted; details thereof will be described later.

Stacked sheets on the cassette 110 are stacked such that recording surfaces thereof are directed toward a cassette-body bottom surface 111*a* (—Z direction side). A sheet is positioned by being regulated at the rear end thereof in the transport direction of the sheet by the rear-end guide 112, at one end thereof in the width direction of the sheet by a regulating portion 145 formed on the first side guide 140, and at the other end thereof in the width direction of the sheet by a regulating portion 155 formed on the second side guide 150.

Figure 4:
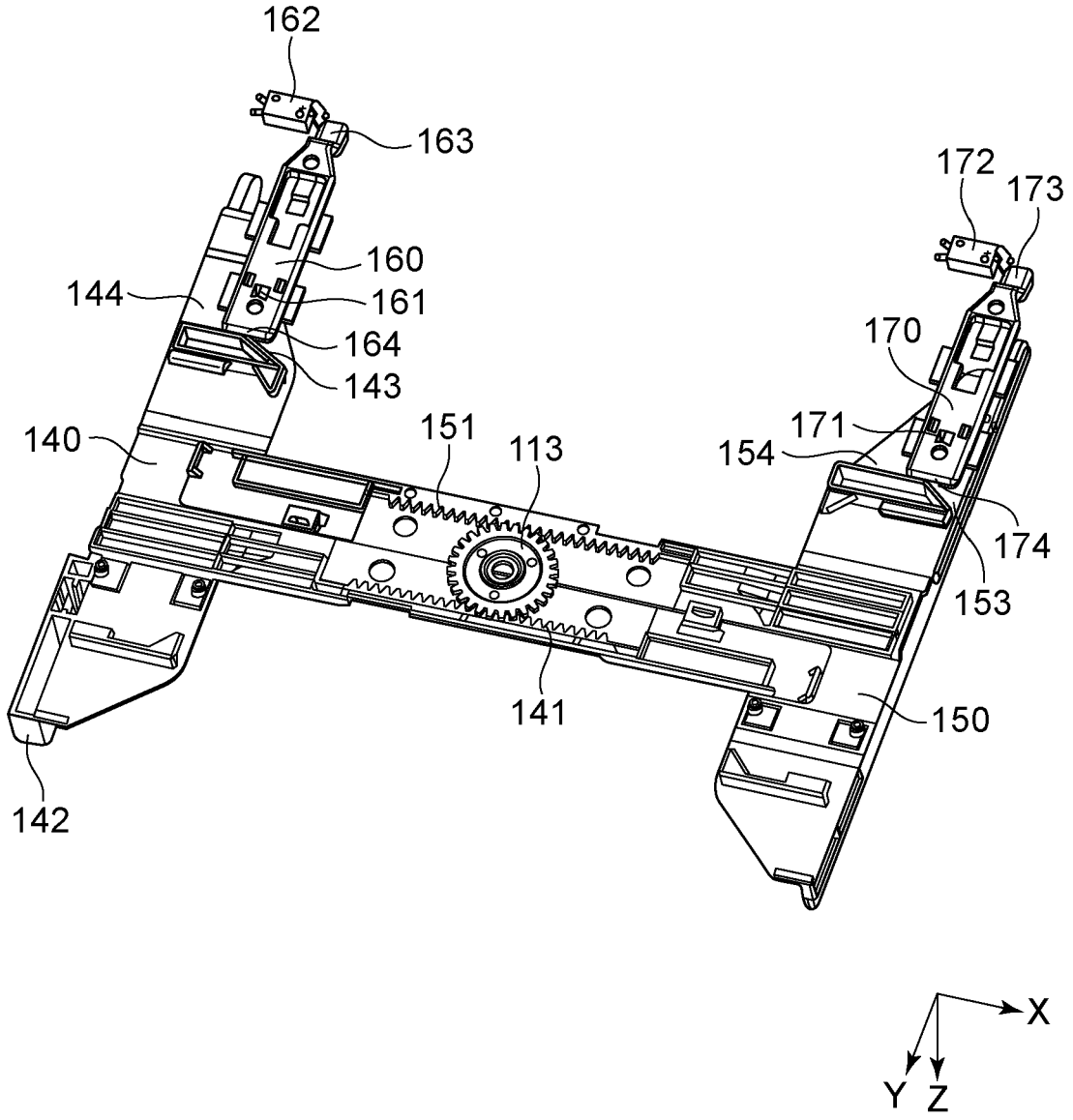
FIG. 4 is a perspective view of side guides and sheet-width detection levers according to the present embodiment.

FIG. 4 is a bottom perspective view of components, which will be described later, relating to the side guides and a sheet-width detection mechanism of the cassette feeding mechanism. The first side guide 140 and the second side guide 150 include rack portions 141 and 151, respectively. The rack portions 141 and 151 engage with the gear 113. When one of the side guides operates in the X direction, the other side guide operates in the opposite direction in conjunction therewith. For example, when the first side guide 140 operates in a direction (+X direction) of abutting a sheet, the second side guide 150 operates in conjunction with the first side guide 140 in a direction (−X direction) of abutting the sheet. The first side guide 140 includes a hold portion 142 configured to be held by a user to operate the first side guide 140. It is desirable that the hold portion be disposed on the side guide on the right side as viewed from the front side (+Y side in the Y direction in the present embodiment) with respect to a user since a large number of users are right handers generally.

Configuration of Size Detection Mechanism: Next, a sheet-size detection mechanism according to the present embodiment will be described. The first sheet-width detection lever 160 and the second sheet-width detection lever 170 are urged in the +Y direction, which is an extraction direction, by urging members 161 and 171, respectively. In the present embodiment, the urging members are springs. The first side guide 140 has an engagement slant surface 143 and a slide surface 144. The second side guide 150 has an engagement slant surface 153 and a slide surface 154. The engagement slant surface 143 and the slide surface 144 each function as an abut portion configured to abut the first sheet-width detection lever 160. The engagement slant surface 153 and the slide surface 154 each function as an abut portion configured to abut the second sheet-width detection lever 170. An angle formed by each engagement slant surface and a movement direction is an acute angle. The first sheet-width detection lever 60 and the second sheet-width detection lever 170 include an engagement portion 164 and an engagement portion 174, respectively, that are configured to abut the abut portions corresponding thereto.

A first switch sensor 162 and a second switch sensor 172 are disposed on the separating plate 130 illustrated in FIG. 2 and configured to be turned ON by being pressed in the −Y direction and turned OFF while not being pressed. Tips of the first sheet-width detection lever 160 and the second sheet-width detection lever 170 in the −Y direction are tip portions 163 and 173. The tip portions 163 and 173 press the first switch sensor 162 and the second switch sensor 172, respectively. Here, the position of the sheet-width detection levers when the switch sensors are turned ON is a first position, and the position thereof when the switch sensors are turned OFF is a second position. In the present embodiment, the first switch sensor 162 and the second switch sensor 172 detect the position of each of the tip portions 163 and 173 in response to being switched between ON and OFF by being physically pressed by the tip portions 163 and 173, respectively. Alternatively, the positions of the tip portions 163 and 173 may be detected by, for example, an optical sensor.

Along with the movement of the first side guide 140 and the second side guide 150 in the X direction, the engagement slant surfaces and the slide surfaces move. As a result of moving in the X direction, the engagement slant surfaces and the slide surfaces engage with the engagement portions of the sheet-width detection levers. The sheet-width detection levers then operate in the −Y direction, which is an intersecting direction intersecting the sheet-width direction. In other words, the engagement slant surfaces and the slide surfaces each function as a driving member of a translation cam that causes the sheet-width detection levers to operate in the Y direction. The sheet-width detection levers are driven members.

The tip portions 163 and 173 of the first sheet-width detection lever 160 and the second sheet-width detection lever 170 in the −Y direction press the first switch sensor 162 and the second switch sensor 172, respectively, to cause the sensors to be turned ON along with the movement of the sheet-width detection levers in the −Y direction.

Figure 5A:
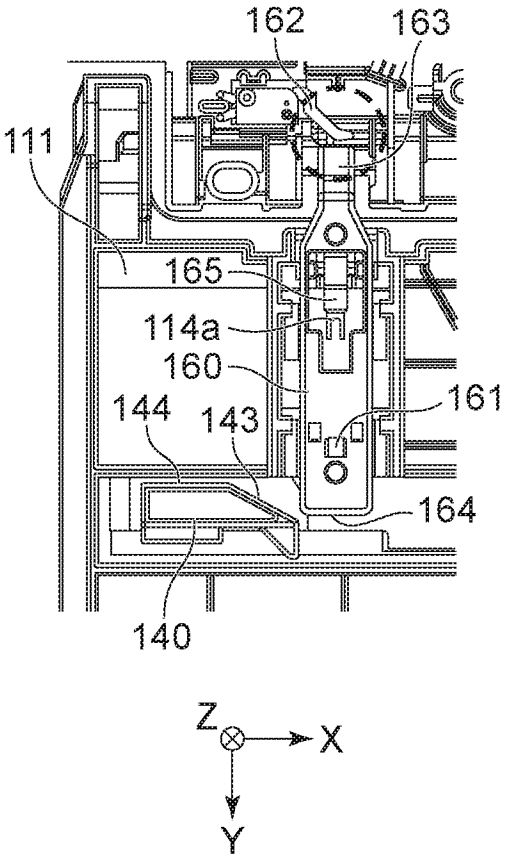
FIG. 5A to FIG. 5C each illustrate an operation of a side guide and a sheet-width detection lever in the present embodiment.
Figure 5B:
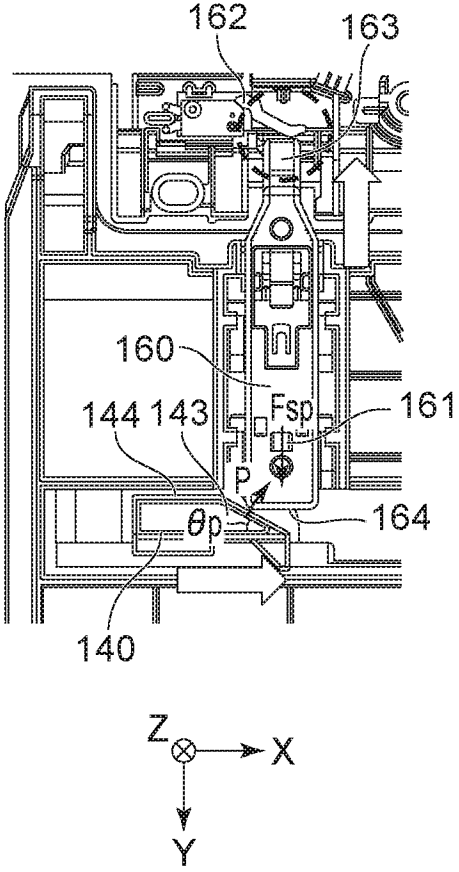
Figure 5C:
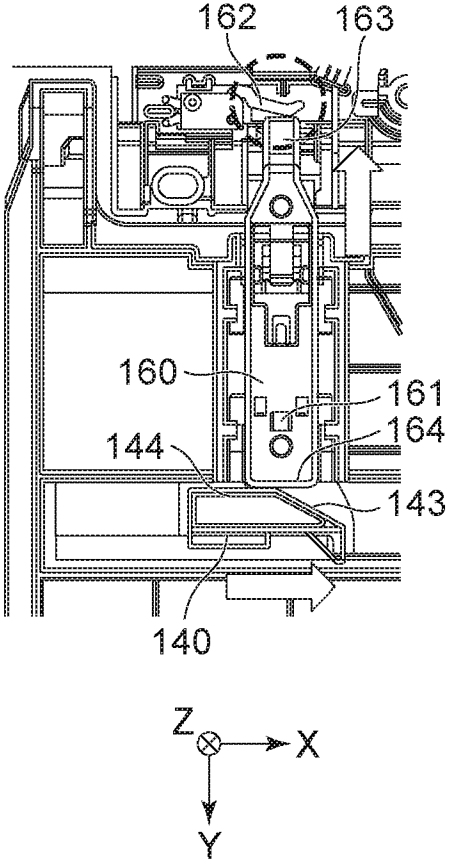

Relationship between Operation of Side Guides and Operation of Sheet-width Detection Levers: FIG. 5A to FIG. 5C are detail illustrations of a series of the flow of causing the first side guide 140 to operate in the X direction with the cassette 110 viewed from the bottom (−Z direction).

As illustrated in FIG. 5A, the first sheet-width detection lever 160 is urged in +Y direction by the urging member 161 and positioned at the second position. In a state in which the side guide 140 is positioned, as in FIG. 5A, on the −X direction side in FIG. 5A, the engagement slant surface 143 and the slide surface 144 are not in contact with the engagement portion 164. Thus, the first sheet-width detection lever 160 does not move in the −Y direction, and the tip portion 163 does not press the first switch sensor 162. The output signal of the first switch sensor 162 thus becomes OFF.

The regulating portion 145 (FIG. 3) of the first side guide 140 is moved (in the order of FIG. 5A→FIG. 5B→FIG. 5C) in the +X direction to be made to abut a sheet. In the process of the movement, the engagement slant surface 143 and the engagement portion 164 abut each other. Further, when the first side guide 140 is moved in the +X direction, a force P is applied from the engagement slant surface 143 to the first sheet-width detection lever 160 as illustrated in FIG. 5B. Due to being regulated by the cassette body 111 so as to operate in only the Y direction, the first sheet-width detection lever 160 moves (FIG. 5B) in the −Y direction by receiving a force from the engagement slant surface 143.

Further, when the first side guide 140 is moved in the +X direction, the first sheet-width detection lever 160 moves in the −Y direction, and the slide surface 144 and the engagement portion 164 enter a state of abutting each other (FIG. 5C). The tip portion 163 of the first sheet-width detection lever 160 enters a state of pressing the first switch sensor 162, and the output signal of the first switch sensor 162 becomes ON. The position of the first sheet-width detection lever 160 in this state is the first position.

The regulating portion 145 of the first side guide 140 is moved (in the order of FIG. 5C→FIG. 5B→FIG. 5A) in the −X direction to be separated from the sheet. In the process of the movement in the −X direction, the engagement portion 164 is separated from the slide surface 144 and abuts the engagement slant surface 143 (FIG. 5B). Due to the first sheet-width detection lever 160 being urged in the +Y direction by the urging member 161, the engagement portion 164 and the engagement slant surface 143 move so as to be in contact with each other constantly. Further, when the first side guide 140 is moved in the −X direction, an abutment portion 165 of the first sheet-width detection lever 160 and a movement regulating portion 114*a* disposed on the cassette body 111 abut each other, and the sheet-width detection lever enters a state of being present at the second position (FIG. 5A). In this state, even when the cassette 110 is in a state of being mounted on the inkjet printer 1, the tip portion 163 and the first switch sensor 162 are in a state of being separated from each other. The output signal of the first switch sensor 162 thus becomes OFF.

FIG. 6A to FIG. 6D are detail illustrations of a series of the flow of causing the second side guide 150 to operate in the X direction with the cassette 110 viewed from the bottom (−Z direction).

Figure 6A:
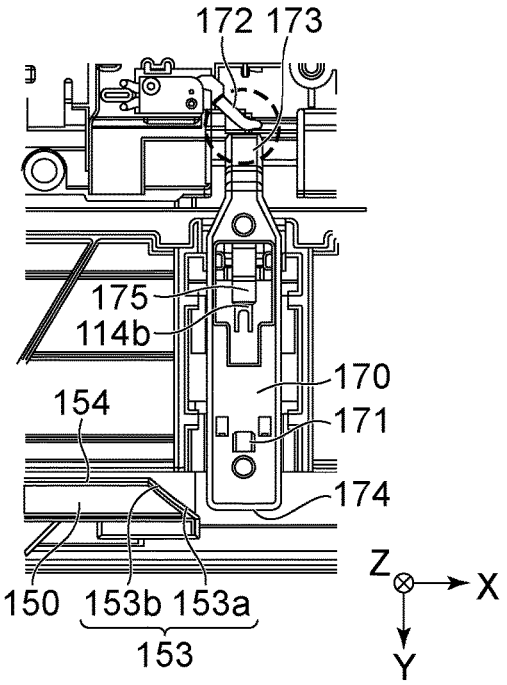
FIG. 6A to FIG. 6D each illustrate an operation of a side guide and a sheet-width detection lever in the present embodiment.

As illustrated in FIG. 6A, the second sheet-width detection lever 170 is urged in the +Y direction by the urging member 171 and positioned at the second position. In a state in which the second side guide 150 is positioned on the −X direction side in the FIG. 6A, the engagement slant surface 153 and the slide surface 154 are not in contact with the engagement portion 174. Therefore, the second sheet-width detection lever 170 does not move in the −Y direction, and the tip portion 173 does not press the second switch sensor 172. The output signal of the second switch sensor 172 thus becomes OFF.

Figure 6B:
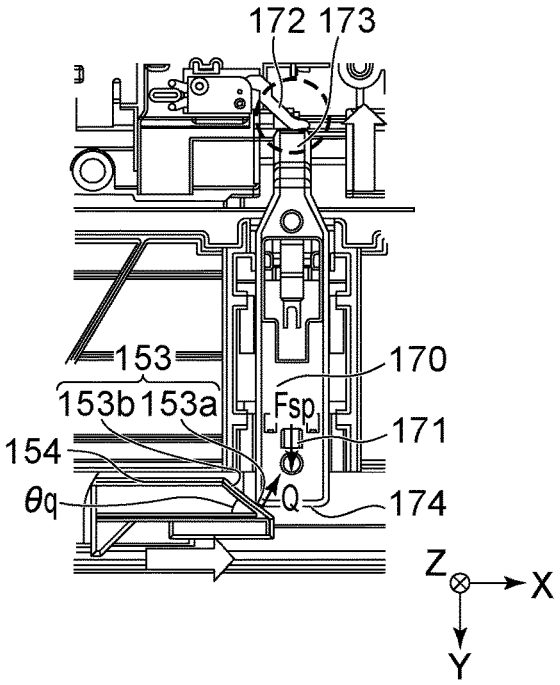

The regulating portion 155 (FIG. 3) of the second side guide 150 is moved (in the order of FIG. 6A FIG. 6B→FIG. 6C→FIG. 6D) in the +X direction to be separated from the sheet. In the process of the movement, an engagement slant surface 153*a* and the engagement portion 174 abut each other. Further, when the second side guide 150 is moved in the +X direction, a force Q is applied from the engagement slant surface 153*a* to the second sheet-width detection lever 170, as illustrated in FIG. 6B. Due to being regulated by the cassette body 111 so as to operate in only the Y direction, the second sheet-width detection lever 170 moves (FIG. 6B) in the −Y direction by receiving a force from the engagement slant surface 153*a*.

Figure 6C:
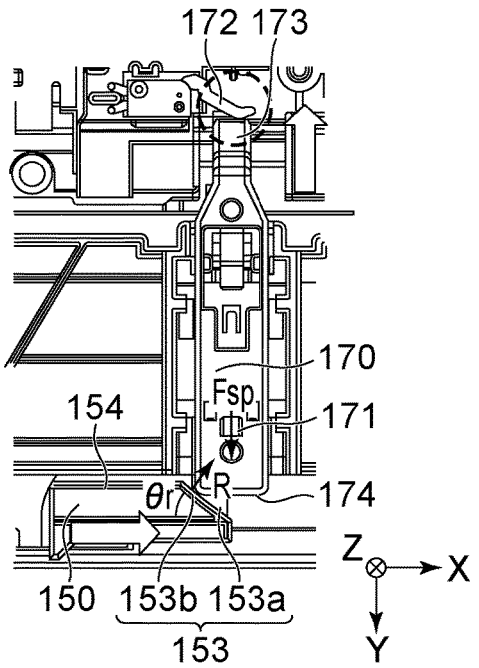

Further, when the second side guide 150 is moved in the +X direction, the state in which the engagement slant surface 153*a* abuts the engagement portion 174 becomes a state in which an engagement slant surface 153*b* abuts the engagement portion 174 as illustrated in FIG. 6C. A force R, illustrated in FIG. 6C, is applied from the engagement slant surface 153*b* to the second sheet-width detection lever 170.

Figure 6D:
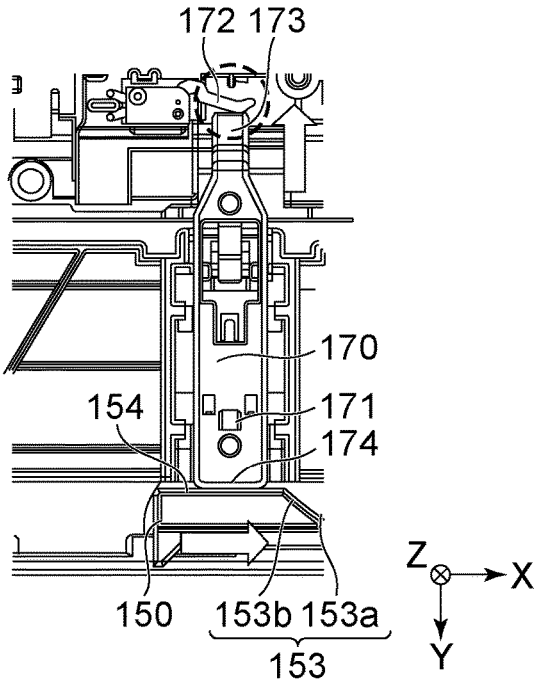

Further, when the second side guide 150 is moved in the +X direction, the second sheet-width detection lever 170 moves in the −Y direction to move to the first position (FIG. 6D). At this time, the slide surface 154 and the engagement portion 174 are in a state of abutting each other. The tip portion 173 of the second sheet-width detection lever 170 is in a state of pressing the second switch sensor 172, and the output signal of the second switch sensor 172 becomes ON.

The regulating portion 155 of the second side guide 150 is moved (in the order of FIG. 6D→FIG. 6C→FIG. 6B→FIG. 6A) in the −X direction to be made to abut the sheet (to regulate the position of the sheet). In the process of the movement in the −X direction, the engagement portion 174 separates from the slide surface 154 and abuts the engagement slant surface 153 (FIG. 6C, FIG. 6B). Due to the second sheet-width detection lever 170 being urged in the +Y direction by the urging member 171, the engagement portion 174 and the engagement slant surface 153 move so as to be in contact constantly. Further, when the second side guide 150 is moved in the −X direction, an abutment portion 175 of the second sheet-width detection lever 170 and a movement regulating portion 114*b* disposed on the cassette body 111 abut each other, and the second sheet-width detection lever enters a state of being present at the second position (FIG. 6A). In this state, even in a state in which the cassette 110 is mounted on the inkjet printer 1, the tip portion 173 and the second switch sensor 172 are in a state of being separated from each other. The output signal of the second switch sensor 172 thus becomes OFF.

Relationship between Sheet Sizes and Output Signals of Switch Sensors: The cassette 110 is capable of being stacked with sheets having sizes of a plurality of types. An example in which sheet sizes of three types including A4, B5, and A5 are detected by the sheet-width detection mechanism is presented below.

Figure 7:
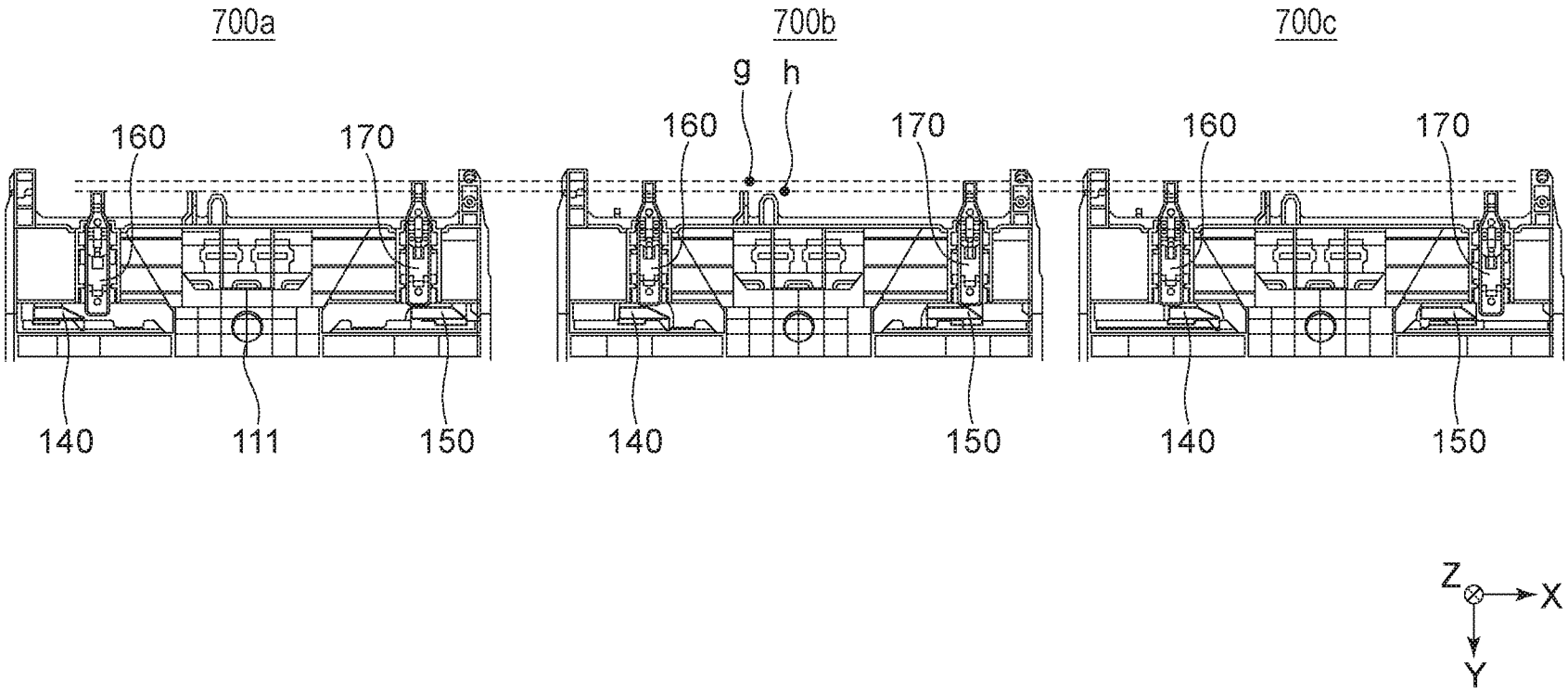
FIG. 7 illustrates a positional relationship between sheet widths and the sheet-width detection levers in the present embodiment.

FIG. 7 illustrates a positional relationship between the sheet widths and the sheet-width detection levers. Illustrated in 700*a* is a positional relationship between the side guides and the sheet-width detection levers with the side guides set for a sheet having the A4 width (210 mm). Illustrated in 700*b* is a positional relationship between the side guides and the sheet-width detection levers with the side guides set for a sheet having the B5 width (182 mm). Illustrated in 700*c* is a positional relationship between the side guides and the sheet-width detection levers with the side guides set for a sheet having the A5 width (148 mm). In FIG. 7, a line g indicates the position of the tip portions 163 and 173 with the sheet-width detection levers 160 and 170 positioned at the first position, and a line h indicates the position of the tip portions 163 and 173 with the sheet-width detection levers 160 and 170 positioned at the second position.

FIG. 8 is a table showing a correlation between the output signal of each switch sensor and the positional relationship of the side guides. In the present embodiment, the state in which the cassette 110 is extracted from the inkjet printer 1 is detected on the basis of the first switch sensor 162 and the second switch sensor 172 being turned OFF. Therefore, it is configured such that, in the state in which the cassette 110 is mounted on the inkjet printer 1, the first switch sensor 162 and the second switch sensor 172 do not simultaneously enter a state of being turned OFF and either one of the switch sensors is turned ON.

As described above, in the state in which the cassette 110 is not mounted on the inkjet printer 1, the first sheet-width detection lever 160 and the second sheet-width detection lever 170 do not abut the first switch sensor 162 and the second switch sensor 172, respectively. Therefore, the output signals of the first switch sensor 162 and the second switch sensor 172 both become OFF. When a sheet having the A4 width is set, the first switch sensor 162 is turned OFF since the first sheet-width detection lever 160 is present at the second position, and the second switch sensor 172 is turned ON since the second sheet-width detection lever 170 is present at the first position. When a sheet having the B5 width is set, the first switch sensor 162 is turned ON since the first sheet-width detection lever 160 is present at the first position, and the second switch sensor 172 is turned ON since the second sheet-width detection lever 170 is present at the first position. When a sheet having the A5 with is set, the first switch sensor 162 is turned ON since the first sheet-width detection lever 160 is present at the first position, and the second switch sensor 172 is turned OFF since the second sheet-width detection lever 170 is present at the second position.

Thus, the combination of the output signals, which are detection results of the two switch sensors, enables detection of four states including the three sheet sizes and the cassette extracted state. On the basis of the output signals of the switch sensors, the display portion 9 displays a sheet size, which is determined by the CPU and the like included in the inkjet printer 1, of sheets stacked on the cassette 110 or displays that the cassette 110 is not mounted on the inkjet printer 1. The displaying enables a user to confirm the size of sheets stacked on the cassette 110, without directly confirming the sheets stacked on the cassette 110.

In the above-described embodiment, the three sheet sizes including A4, B5, and A5 are detected. However, other sizes, for example, B4, A4, and B5 may be handled.

In the above-described embodiment, four states in total including the mounted/dismounted state of the cassette and the three sheet sizes are detected. However, for example, it may be configured such that four sheet sizes are detected while the mounted/dismounted state of the cassette is not detected. The required number of the sheet-width detection levers varies in accordance with the number of states to be detected. Thus, for example, when the number of states to be detected is two, the number of sheet-width detection levers may be one, and, when five or more states are intended or predetermined to be detected, the number of the sheet-width detection levers may be three or more. There may be included a single regulating portion, and sheets may be regulated by the cassette 110 and the single regulating portion.

Required Force for Operation of Side Guides: The magnitude of the force required for operating the first side guide 140 will be described. Here, a force applied by the first sheet-width detection lever 160 and the second sheet-width detection lever 170 to the slide surfaces 144 and 154 is sufficiently small, compared with a force applied by the first sheet-width detection lever 160 and the second sheet-width detection lever 170 to the engagement slant surfaces 143 and 153. Therefore, only the force applied by the first sheet-width detection lever 160 and the second sheet-width detection lever 170 to the engagement slant surfaces 143 and 153 is considered here.

The sheet-width detection levers mainly require a force when moving from the second position to the first position. When the sheet-width detection lever 160 moves from the second position to the first position in response to the side guide 140 being moved in +X direction in order to set the side guide for a sheet is when the sheet has the B5 width where the first switch sensor 162 is switched from OFF to ON. The second sheet-width detection lever 170 does not move from the second position to the first position. When the second sheet-width detection lever 170 moves from the second position to the first position in response to the first side guide 140 being moved in the −X direction in order to separate the first side guide 140 from a sheet is when the sheet has the B5 width where the second switch sensor 172 is switched from OFF to ON. The first sheet-width detection lever 160 does not move from the second position to the first position.

First, an operation of moving the first side guide 140 in the +X direction to cause the side guide to abut a sheet will be presented. When the first side guide 140 is moved in the +X direction, the engagement slant surface 143 and the first sheet-width detection lever 160 abut each other (FIG. 5B). Upon the abutment, the force P is applied to the sheet-width detection lever 160, and a reaction of the force P is applied to the first side guide 140. Here, the friction coefficient of the first side guide 140 and the cassette body 111 is represented by a friction coefficient μ, an angle formed by the direction of the contact tangent between the engagement slant surface 143 and the engagement portion 164 and a movement direction of the first side guide 140 is represented by Op, and an urging force applied by the urging member 161 to the sheet-width detection lever 160 is represented by Fsp. An increment Fp of a force required for the operation of the first side guide 140 in the X direction by a force of the reaction of the force P is indicated as the following formula (1).

$$Fp=Fsp\times(\tan\theta p+\mu) \quad (1)$$

Next, an operation of moving the first side guide 140 in the −X direction to separate the side guide from a sheet is presented. When the first side guide 140 is moved in the −X direction, the engagement slant surface 153 and the sheet-width detection lever 170 abut each other (FIG. 6B, FIG. 6C). Upon the abutment, the forces Q and R are applied to the second sheet-width detection lever 170, and reactions of the forces Q and R are applied to the second side guide 150. Here, an angle formed by the direction of the contact tangent between the engagement slant surface 153*a* and the engagement portion 174 and a movement direction of the second side guide 150 is represented by θq, and an angle formed by the direction of the contact tangent between the engagement slant surface 153*b* and the engagement portion 174 and the movement direction of the second side guide 150 is represented by θr. Increments Fq' and Fr' of forces required for the operation of the second side guide 150 in the X direction by the forces of reactions of the forces Q and R are indicated as the following formula (2) and formula (3), respectively.

$$Fq'=Fsp\times(\tan\theta q+\mu) \quad (2)$$

$$Fr'=Fsp\times(\tan\theta r+\mu) \quad (3)$$

Actually, a user holds and operates the hold portion 142 to move the first side guide 140. Therefore, the force required for moving the first side guide 140 is obtained by diving the force required for moving the second side guide 150 by the efficiency of transmission by a drive train.

The transmission efficiency of the force transmitted from the first side guide 140 to the second side guide 150 through the rack portions 141 and 151 and the gear 113 is represented by a transmission efficiency η. The increments Fq and Fr of the force required for the operation of the first side guide 140 in the width direction by the forces of reactions of the forces Q and R are indicated as the following formula (4) and formula (5), respectively.

$$Fq'=(Fsp\times(\tan\theta q+\mu) \quad (4)$$

$$Fr'=(Fsp\times(\tan\theta r+\mu) \quad (3)$$

The transmission efficiency η is a value less than 100%. Therefore, as indicated by the aforementioned formulas, the force required for operating the first side guide 140 to move the second sheet-width detection lever 170 from the second position to the first position through the second side guide 150 is increased by an amount increased as a result of the division by the transmission efficiency, compared with the force required for moving the first sheet-width detection lever 160 from the first position to the second position.

The operation for causing the side guides to abut a sheet requires a precise operation. When a force required for an operation is large, there is a possibility of a user applying an excessively large force to the side guides and thereby pushing the side guides against the sheet. When the side guides are pushed against a sheet, there may occur cases in which the sheet is folded and in which an end portion of the sheet is flipped. When feeding and recording of such a sheet are performed, malfunctions, including smudges of the sheet and occurrence of a jam during a recording operation, may occur. Therefore, it is desirable that the increment of the force required for operating the side guides by the sheet-width detection levers in the operation of causing the side guides to abut a sheet be as small as possible.

In contrast, for the operation of separating the side guides from a sheet, such a too precise operation is not required. The increment of the force required for operating the side guides by the sheet-width detection levers thus can be slightly large. Therefore, in the present embodiment, the first sheet-width detection lever 160 is moved from the second position to the first position in the operation of causing the side guides to abut a sheet. For the operation of separating the side guides from a sheet, it is configured such that the second sheet-width detection lever 170 is moved from the second position to the first position. Consequently, in the operation in which a user causes the side guides to abut a sheet, the force required for operating the side guide on the operation side increases while the force required for operating the side guide on the non-operation side decreases. Conversely, in the operation in which a user separates the side guides from a sheet, the force required for operating the side guide on the operation side decreases while the force required for operating the side guide on the non-operation side increases. As described above, the force required for moving the first sheet-width detection lever 160 to the first position is smaller than the force required for moving the second sheet-width detection lever 170 to the first position. Therefore, this configuration provides an effect of reducing the total of the forces required for moving the side guides in the operation of causing the side guides to abut a sheet so as to be smaller than that in the operation of separating the side guides from a sheet.

Engagement Slant Surface of Side Guide: As indicated by the aforementioned formula, as the value of each of Op in FIG. 5B, θq in FIG. 6B, and θr in FIG. 6C increases, the force required for operating the side guides increases. As described above, it is desirable that the force required for operating the side guides be small in the operation of causing the side guides to abut a sheet. Therefore, to improve the convenience of users, the present embodiment employs a configuration in which an angle formed in the operation of causing the side guides to abut a sheet by the direction of the contact tangent between the side guides and the sheet-width detection levers and the movement direction of the side guides is as small as possible.

As described above, the sizes of sheets detected in the present embodiment are three types including the A4 width (210 mm), the B5 width (182 mm), and the A5 width (148 mm). The difference between the sizes is 28 mm between the widths A4 and B5 and 34 mm between the widths B5 and A5, that is, larger between the widths B5 and A5. It is configured such that Op is smaller than θq and θr since it is possible between the widths B5 and A5 to set a larger width-direction movement amount of the side guides 140 and 150 required for moving the sheet-width detection levers 160 and 170 from the second position to the first position, than between the widths A4 and B5. This configuration provides an effect of further reducing the total of the forces required for moving the side guides in the operation of causing the side guides to abut a sheet so as to be smaller than in the operation of separating the side guides from a sheet. As described above, the operation of causing the side guides to abut a sheet requires a precise operation. Thus, setting θp to be smaller than θq and θr enables the operation for causing the side guides to abut a sheet to be performed more easily.

OTHER EMBODIMENTS

In the above-described embodiment, an application to a feeding apparatus in an inkjet printer is presented; however, applications to printers in other forms, such as a laser printer, and a feeding apparatus of a scanner, such as an ADF may be possible.

According to an embodiment of the present disclosure, there is provided with a technology that performs, with a simple configuration, size detection of sheets stacked on a stacking portion.

Embodiment(s) of the present disclosure can also be realized by a computer of a system or apparatus that reads out and executes computer executable instructions one or more programs) recorded on a storage medium (which may also be referred to more fully as a 'non-transitory computer-readable storage medium') to perform the functions of one or more of the above-described embodiment(s) and/or that includes one or more circuits e application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may include one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read-only memory (ROM), a storage of distributed computing systems, an optical disk (such as a compact disc (CD), digital versatile disc (DVD), or Blu-ray Disc (BD)™), a flash memory device, a memory card, and the like.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2019-141566, filed Jul. 31, 2019, which is hereby incorporated by reference herein in its entirety.

What is claimed is:

1. A feeding apparatus comprising:

a stacking portion configured to be stacked with sheets having different widths;

a regulating portion disposed on the stacking portion to be movable in a width direction of the sheets and configured to abut one side of the stacked sheets in the width direction and regulate movement of the sheets in the width direction;

a moving portion disposed on the stacking portion and movable to a first position and a second position in an intersecting direction intersecting the width direction in accordance with a position of the regulating portion;

a detection unit configured to detect a position of the moving portion in the intersecting direction; and a determination unit configured to determine a size of the sheets stacked on the stacking portion based on a detection result of the detection unit, wherein, an abut portion configured to move along with a movement of the regulating portion in the width direction, and the moving portion change position between the first position and the second position depending on a change in abutting or not abutting state between the abutting part and the moving part, and wherein, when the moving portion has moved to the first position by movement of the regulating portion in a predetermined proceeding direction, the moving portion does not move from the first position while the regulating portion takes a position where the regulating portion further moves in the predetermined proceeding direction.

2. The feeding apparatus according to claim 1, wherein, when the moving portion has moved to the second position by movement of the regulating portion in a direction opposite of the predetermined proceeding direction, the moving portion does not move from the second position while the regulating portion takes a position where the regulating portion further moves in the opposite direction of the predetermined proceeding direction.

3. The feeding apparatus according to claim 1, wherein, when the regulating portion moves in a direction of abutting the sheets, the moving portion moves from the second position to the first position.

4. The feeding apparatus according to claim 1, wherein, when the regulating portion moves in a direction of separating from the sheets, the moving portion moves from the first position to the second position.

5. The feeding apparatus according to claim 1, wherein an angle formed by a direction of a contact tangent between the abut portion and the moving portion and movement direction of the regulating portion is an acute angle.

6. The feeding apparatus according to claim 1, wherein the stacking portion is dismountable with respect to a body of the feeding apparatus.

7. The feeding apparatus according to claim 6, wherein the moving portion is configured to move in a direction in which the stacking portion is mounted and dismounted.

8. The feeding apparatus according to claim 1, further comprising a feeding unit configured to feed the sheets from the stacking portion to an inner portion of the feeding apparatus.

9. The feeding apparatus according to claim 1, further comprising a recording unit configured to record an image on a sheet.

10. A feeding apparatus comprising:

a stacking portion configured to be stacked with sheets having different widths;

a first regulating portion disposed on the stacking portion to be movable in a width direction of the sheets and configured to abut one side of the stacked sheets in the width direction and regulate movement of the sheets in the width direction;

a second regulating portion disposed on the stacking portion to be movable in the width direction of the sheets and configured to abut another side of the stacked sheets in the width direction and regulate the movement of the sheets in the width direction;

a first moving portion disposed on the stacking portion and movable to a first position and a second position in an intersecting direction intersecting the width direction in accordance with a position of the first regulating portion;

a second moving portion disposed on the stacking portion and movable to the first position and the second position in the intersecting direction in accordance with a position of the second regulating portion;

a detection unit configured to detect the position of each of the first moving portion and the second moving portion in the intersecting direction; and a determination unit configured to determine a size of the sheets stacked on the stacking portion based on a detection result of the detection unit, wherein, by abutting or not abutting respective abut portions configured to move along with respective movement of the first regulating portion and the second regulating portion in the width direction, the first moving portion moves to the first position and the second position and the second moving portion moves to the first position and the second position.

11. The feeding apparatus according to claim 10, wherein the second regulating portion is configured to move along with movement of the first regulating portion, wherein, when the first regulating portion moves in a direction of abutting the sheets, the second regulating portion also moves in a direction of abutting the sheets, and wherein, when the first regulating portion moves in a direction of separating from the sheets, the second regulating portion also moves in a direction of separating from the sheets.

12. The feeding apparatus according to claim 10, wherein, when the first regulating portion moves in a direction of abutting the sheets, the first moving portion moves from the second position to the first position.

13. The feeding apparatus according to claim 12, wherein, when the second regulating portion moves in a direction of abutting the sheets, the second moving portion moves from the first position to the second position.

14. The feeding apparatus according to claim 12, wherein a first length between the first regulating portion and the second regulating portion in the width direction when the first moving portion moves from the second position to the first position and a second length between the first regulating portion and the second regulating portion in the width direction when the second moving portion moves from the first position to the second position differ from each other.

15. The feeding apparatus according to claim 10, wherein the abut portion of the first regulating portion is configured such that an angle formed by a direction of a contact tangent between the abut portion and the first moving portion and movement direction of the first regulating portion is an acute angle when the first moving portion moves to the position of the first moving portion.

16. The feeding apparatus according to claim 15, wherein an angle formed by the abut portion disposed on the first regulating portion is smaller than an angle formed by the abut portion disposed on the second regulating portion.

17. The feeding apparatus according to claim 10, wherein the first moving portion and the second moving portion are not simultaneously positioned at the second position.

18. The feeding apparatus according to claim 17, wherein the determination unit determines that the stacking portion is not in a state of being mounted on the feeding apparatus when the detection unit detects that both the first moving portion and the second moving portion are present at the second position.

19. The feeding apparatus according to claim 10, further comprising a hold portion to move the first regulating portion.

20. The feeding apparatus according to claim 10, wherein the stacking portion is dismountable from a body of the feeding apparatus.

21. The feeding apparatus according to claim 20, wherein the first moving portion and the second moving portion are configured to move in a direction in which the stacking portion is mounted and dismounted.

* * * * *